US006241627B1

(12) United States Patent
Kasashima et al.

(10) Patent No.: US 6,241,627 B1
(45) Date of Patent: Jun. 5, 2001

(54) DIMPLED GOLF BALL

(75) Inventors: Atsuki Kasashima; Hirotaka Shimosaka; Keisuke Ihara, all of Chichibu-shi (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/365,247

(22) Filed: Jul. 30, 1999

(30) Foreign Application Priority Data

Jul. 30, 1998 (JP) ..... 10-215301

(51) Int. Cl.[7] ..... A63B 37/14

(52) U.S. Cl. ..... 473/384; 473/378; 473/379; 473/380; 473/381; 473/382; 473/383; 473/384

(58) Field of Search ..... 473/378–384

(56) References Cited

U.S. PATENT DOCUMENTS 4,142,727 * 3/1979 Shaw et al. ..... 273/232
4,729,861 * 3/1988 Lynch ..... 264/219
4,858,923 * 8/1989 Gobush ..... 273/62
4,915,390 * 4/1990 Golbush ..... 273/232
5,062,644 * 11/1991 Lee ..... 273/232
5,080,367 * 1/1992 Lynch ..... 273/232
5,149,100 * 9/1992 Melvin ..... 273/232
5,470,075 * 11/1995 Nesbitt ..... 273/220
5,575,477 * 11/1996 Hwang ..... 473/379
5,766,098 * 6/1998 Molitor ..... 473/377

* cited by examiner

*Primary Examiner*—Lee Young
*Assistant Examiner*—Paul D. Kim
(74) *Attorney, Agent, or Firm*—Sughrue, Mion, Zinn, Macpeak & Seas, PLLC

(57) ABSTRACT

A golf ball has plural types of dimples on a spherical surface, which is assumed to be a regular icosahedron having twenty triangles. Apexes of five triangles join together at a vertex. Those dimples arranged in each triangle constitute an arrangement unit. A first dimple having a smallest diameter is located at the vertex, and second dimples having a greater diameter are equidistantly arranged around the first dimple. When a pentagon which circumscribes the second dimples is drawn, an average depth of those dimples located within the pentagon is up to 85% of the average depth of those dimples located in the remaining areas.

16 Claims, 2 Drawing Sheets

DIMPLED GOLF BALL

This invention relates to a dimpled golf ball having improved flight performance.

BACKGROUND OF THE INVENTION

Golf balls are generally formed with a multiplicity of dimples of circular plane shape on their surface in order to improve their aerodynamic characteristics. It is well known that the dimpled golf balls fly better than dimple-free golf balls having a smooth spherical surface.

The flight distance of golf balls is dictated by many factors including the initial velocity and spin rate of the ball, drag and lift acting on the ball in flight, and weather conditions. It has been considered difficult to make theoretical analysis on golf balls with the aim of increasing their flight distance.

For improving the flight performance of the ball except for the initial velocity which is largely governed by the material of the ball, a number of attempts of tailoring dimples relating to the geometrical factors of the ball have been made. Such attempts include, for example, increasing the diameter of dimples, using plural types of dimples having different diameters, increasing or decreasing the depth of dimples, changing the shape of dimples from circular one to polygonal and other shapes, and increasing or decreasing the number of dimples. Certain improvements have been made.

None of these attempts succeeded in developing a golf ball having satisfactory flight performance when judged from the skill level of professional golfers. Further improvement and development of golf balls are desired.

SUMMARY OF THE INVENTION

An object of the invention is to provide a dimpled golf ball having improved flight performance.

Regarding a dimpled golf ball wherein the spherical surface is assumed to be substantially a regular icosahedron or pseudo-icosahedron (20-sided polyhedron) having twenty triangles, and those dimples arranged in each triangle constitute an arrangement unit, the inventor has succeeded in optimizing the arrangement, diameter and depth of dimples.

The invention is directed to a golf ball having plural types of dimples on a spherical surface. The spherical surface is assumed to be substantially a regular icosahedron or pseudo-icosahedron having twenty triangles. Apexes of five triangles join together at a vertex. Those dimples arranged in each triangle constitute an arrangement unit.

In a first embodiment, a first dimple having the smallest diameter is located substantially at the vertex, and second dimples having a greater diameter than the first dimple are closely and equidistantly arranged around the first dimple. When a pentagon which circumscribes the second dimples is drawn with its center at the vertex, the average depth of those dimples located within the pentagon is up to 85% of the average depth of those dimples located in the remaining areas outside the pentagon.

In a second embodiment, first dimples having the smallest diameter are equidistantly arranged substantially around the vertex. When a pentagon which circumscribes the first dimples is drawn with its center at the vertex, the average depth of those dimples located within the pentagon is up to 95% of the average depth of those dimples located in the remaining areas outside the pentagon.

The golf balls having dimples arranged according to the first and second embodiments, when hit with a driver, exhibit excellent flight performance and aerodynamic symmetry.

DESCRIPTION OF THE PREFERRED EMBODIMENTS

The golf ball of the invention has plural types of dimples on its spherical surface. For the purpose of defining a dimple arrangement, the spherical surface is assumed to be substantially a regular icosahedron or pseudo-icosahedron (20-sided polyhedron) having twenty triangles. Those dimples arranged in each triangle constitute an arrangement unit. That is, the overall dimple arrangement is reached by repeating the dimple arrangement pattern of each triangle over the entire surface.

First Embodiment

Figure 1:
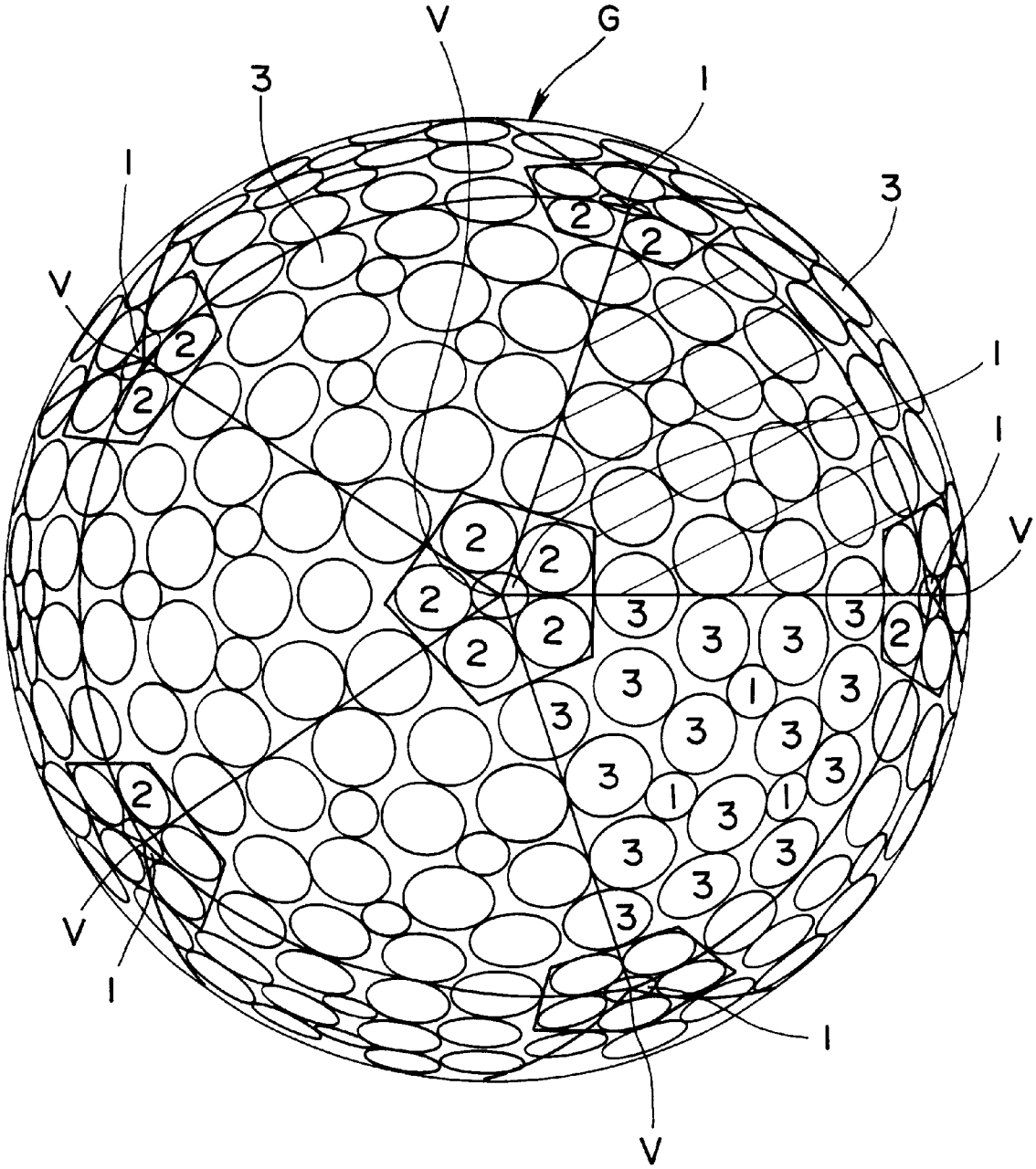
FIG. 1 illustrates a dimple arrangement pattern on a golf ball according to the first embodiment of the invention.

The golf ball according to the first embodiment of the invention is first described. FIG. 1 is a plane view of one exemplary golf ball G according to the first embodiment. The golf ball G has a spherical surface which is herein assumed to be a substantial regular icosahedron having twenty triangular areas which are defined and delimited by (straight) solid lines in the figure. One triangular area delimited by solid lines contains plural types of dimples which constitute an arrangement unit. The number of types of dimples is not critical although it is usually two to five.

In the golf ball shown in FIG. 1 according to the first embodiment, apexes of five triangles join together at a vertex V. A first dimple 1 of a smallest diameter is located about the vertex V. Specifically, the first dimple 1 is centered substantially at the vertex V. The first dimple 1 at the vertex V is divided into substantially ⅕ sections among the five triangular areas. If the spherical surface is assumed to be a pseudo-icosahedron and the first dimple is located thereon, the common vertex of triangles might be somewhat offset from the center of the first dimple. Such a slight positional offset is within tolerance.

In the first embodiment, second dimples 2 having a greater diameter than the first dimple 1 are closely and equidistantly arranged around the first dimple 1. In FIG. 1, one second dimple 2 is located in each triangular area to surround the first dimple 1. The invention is not limited thereto, and each second dimple may be located so as to partially overlie one side of the triangle.

In the golf ball G of the first embodiment, a multiplicity of dimples are arranged on the surface like conventional golf balls. A pentagon that encloses only the first and second dimples and centers at the vertex V is drawn on the surface. In the first embodiment, those dimples located within the pentagonal area and those dimples located in the remaining areas outside the pentagonal area are optimized in depth so as to enhance the flight performance of the ball.

The "diameter" of a dimple is a diameter or span between two opposed intersections of the dimple with the land (or the spherical surface where no dimples are formed), that is, between two opposed highest points of the dimple. Most golf balls are coated with paint and in such a case, the diameter is that of the dimple in the coated state. The "depth" of the dimple is the vertical distance between the bottom (or the deepest position) of the dimple and the center of an imaginary plane which is drawn by connecting the intersections of the dimple with the land.

The golf ball of the first embodiment requires that within the triangular areas defined, the average depth of those dimples located within the pentagonal area (circumscribing the first and second dimples) be up to 85% and preferably 70 to 85% of the average depth of those dimples located in the remaining areas. If the average depth of the former dimples exceeds 85% of the average depth of the latter dimples, the ball fails to achieve the desired flight performance.

According to the invention, the first dimple should have the smallest diameter among all the dimples arranged on the ball. Typically, the first dimple has a diameter of 2.0 to 3.3 mm, especially 2.3 to 2.9 mm and a depth of 0.05 to 0.15 mm, especially 0.07 to 0.12 mm. The second dimples arranged equidistantly around the first dimple should have a greater diameter than the first dimple. Typically, the second dimples have a diameter of 2.8 to 3.8 mm, especially 3.0 to 3.5 mm and a depth of 0.10 to 0.18 mm, especially 0.12 to 0.16 mm.

Those dimples located in the remaining areas (designated remaining dimples, hereinafter) include the first and second dimples and preferably other dimples of a greater diameter. The remaining dimples are arranged in the triangular area as a unit. It is preferred that the remaining dimples be arranged in plural triangular areas in the same manner. It is acceptable that dimples overlie one side of the triangle.

With respect to the types of dimples on the golf ball surface, it is recommended that those dimples having a larger diameter have a greater depth. For example, the dimples on the golf ball G of FIG. 1 have an increasing diameter in the order of first dimple<second dimples<other dimples, and accordingly, the dimples have an increasing depth in the order of first dimple<second dimples<other dimples, that is, in proportion to their diameter. Where more than three types of dimples are included, it is recommended that the fourth and other types of dimples have a greater depth in proportion to their diameter.

Referring again to FIG. 1, the vertex V where the apexes of five triangles join together is depicted at the center of the golf ball G in the figure. One first dimple 1 is located about the vertex V. Five second dimples 2 are located adjacent to the first dimple and in substantial tangential contact with the two sides of each triangle extending from the vertex V.

When a central pentagon enclosing the five second dimples 2 is drawn to circumscribe the second dimples 2, there appear in FIG. 1 five pentagons arranged radially around the central pentagon. Twelve pentagons are present on the overall spherical surface of the ball.

In the first embodiment, the total number of dimples is not critical. Usually, in each of the twelve pentagonal areas, one first dimple and five second dimples are formed. The total number of dimples formed throughout the golf ball G is usually 252 to 492, and preferably 362 to 462.

In FIG. 1, seventy two (72) first and second dimples 1 and 2 are formed in all the pentagonal areas. In the remaining areas other than the pentagonal areas, sixty (60) first dimples 1 and three hundred (300) other dimples 3 having a greater diameter than the second dimples 2 are formed. The total number of dimples formed throughout the golf ball is 432.

In the golf ball of the first embodiment, the dimple arrangement may be adjusted, without departing from the above range, so as to impart better flight performance. For example, when an imaginary sphere free of dimples is compared with a dimpled golf ball, it is recommended that the total volume of dimples is 0.6 to 1.2%, more preferably 0.7 to 0.9% of the volume of the sphere. It is also recommended that the total area of dimples is at least 65%, more preferably 70 to 85% of the entire surface area of the sphere.

Second Embodiment

Figure 2:
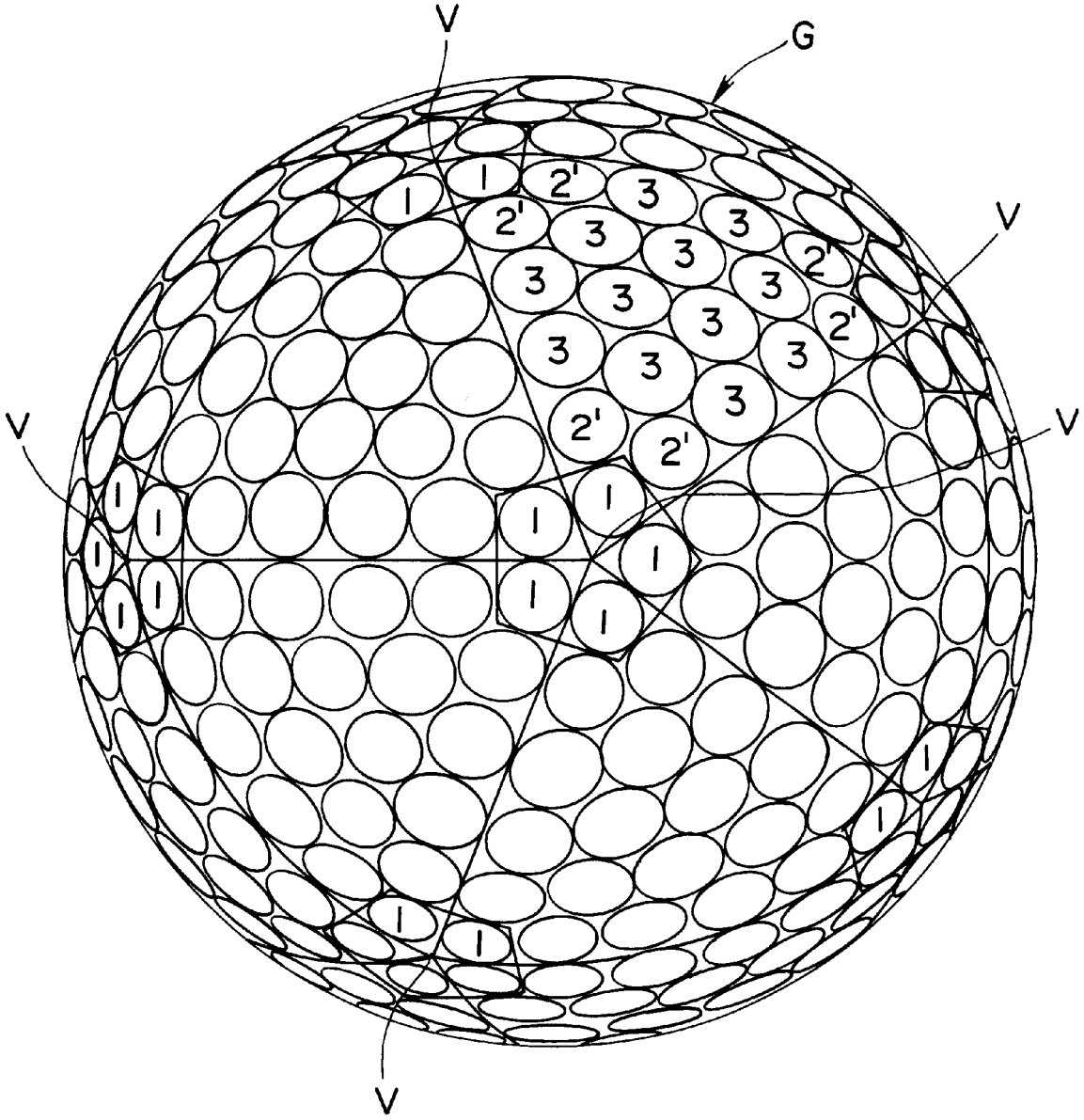
FIG. 2 illustrates a dimple arrangement pattern on a golf ball according to the second embodiment of the invention.

The golf ball according to the second embodiment of the invention is described. FIG. 2 is a plane view of one exemplary golf ball G according to the second embodiment. The golf ball G has a spherical surface which is herein assumed to be a substantial regular icosahedron having twenty triangular areas. A plurality of first dimples having the smallest diameter are arranged around the vertex V where apexes of five triangles join together. Plural types of dimples are arranged throughout the ball as in the first embodiment.

In the golf ball shown in FIG. 2 according to the second embodiment, first dimples 1 are located, at positions corresponding to the second dimples 2 in the first embodiment (FIG. 1), to be in tangential contact with two sides of each triangle near the vertex V (actually not in contact). The first dimples 1 may be located to overlie either one side insofar as they are equidistantly arranged around the vertex V.

The dimple arrangement in the second embodiment is as follows. A pentagon that encloses only the first dimples and centers at the vertex V is drawn on the surface. Those dimples located within the pentagonal area and those dimples located outside the pentagonal area are optimized in depth. The golf ball of the second embodiment requires that the average depth of the first dimples located within the pentagonal area (circumscribing the first dimples) be up to 95% and preferably 80 to 95% of the average depth of those dimples located in the remaining areas. If the average depth of the former dimples exceeds 95% of the average depth of the latter dimples, the ball fails to achieve the desired flight performance.

According to the invention, the first dimples should have the smallest diameter among all the dimples arranged on the ball. Typically, the first dimple has a diameter of 2.0 to 4.0 mm, especially 2.5 to 3.5 mm and a depth of 0.05 to 0.20 mm, especially 0.08 to 0.15 mm.

In the golf ball of the second embodiment requiring that the first dimples be as set forth above, other types of dimples may be arranged in each triangular area as the unit. Preferably other types of dimples having a greater diameter than the first dimples are arranged in the remaining areas. Typically, the other dimples have a diameter of 3.0 to 5.0 mm, especially 3.3 to 4.5 mm and a depth of 0.1 to 0.3 mm, especially 0.12 to 0.25 mm.

With respect to the types of dimples on the golf ball surface, it is recommended like the first embodiment that those dimples having a larger diameter have a greater depth. For example, the dimples on the golf ball G of FIG. 2 have an increasing diameter in the order of first dimples<second dimples<other dimples, and accordingly, the dimples have an increasing depth in the order of first dimples<second dimples<other dimples, that is, in proportion to their diameter. Where more than three types of dimples are included, it is recommended that the fourth and other types of dimples have a greater depth in proportion to their diameter.

In the golf ball G shown in FIG. 2, other dimples having a greater diameter are arranged outside the pentagon circumscribing the first dimples arranged around the vertex V. More specifically, two second dimples 2' having the second smallest diameter are arranged in a second row surrounding the first dimples 1 around the vertex V (total six second dimples in each triangular area), and twelve third dimples 3 having the largest diameter are arranged adjacent the second dimples 2' and in the remainder area. Throughout the golf ball G, the total number of the first dimples 1 within pentagonal areas is 60, and the total number of the other dimples 2' and 3 in the remaining areas is 360, summing to 420 dimples.

The golf ball of the second embodiment is not limited to the illustrated example unless the ball departs from the scope of the invention. In the second embodiment, the total number of the first dimples is 60 while the total number of first and other dimples may range from 360 to 480.

In the golf ball of the second embodiment, the dimple arrangement may be adjusted, without departing from the above range, so as to impart better flight performance. For example, when an imaginary sphere free of dimples is compared with a dimpled golf ball, it is recommended that the total volume of dimples is 0.6 to 1.2%, more preferably 0.7 to 0.9% of the volume of the sphere. It is also recommended that the total area of dimples is at least 65%, more preferably 70 to 85% of the entire surface area of the sphere. Other features may comply with the first embodiment.

EXAMPLE

Examples of the invention are given below by way of illustration and not by way of limitation.

There were prepared two-piece solid golf balls of the large size having three types of dimples in either of the arrangements of FIGS. 1 and 2. The flight performance of each ball was examined by hitting the ball and visually observing its trajectory.

Golf balls of FIG. 1

First dimples within pentagons: 12

Second dimples: 60

Dimples in the remaining areas: 360

Average depth of dimples within pentagons: 83% of the average depth of dimples in the remaining areas Golf balls of FIG. 2

First dimples: 60

Dimples in the remaining areas: 360

Average depth of dimples within pentagons: 92% of the average depth of dimples in the remaining areas In a hitting test with a driver, the balls showed a tendency that the highest point on the trajectory was shifted toward the landing point whereby the total distance was accordingly increased.

There has been described a golf ball on which dimples are arranged in an optimum manner to achieve excellent flight performance.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball having plural types of dimples on a spherical surface, wherein the spherical surface is substantially a regular icosahedron or pseudo-icosahedron having twenty triangles, apexes of five triangles joined together at a vertex formed by each apex of said triangles, those dimples arranged in each triangle constitute an arrangement unit, a first dimple having a smallest diameter is located substantially at each vertex on the overall spherical surface, five second dimples having a greater diameter than that of the first dimple are closely and equidistantly arranged around the first dimple, and when a pentagon which circumscribes the five second dimples is drawn with its center at the vertex, an average depth of those dimples located within twelve pentagons on the overall spherical surface is up to 85% of the average depth of those dimples located in the remaining areas outside the pentagon.

2. The golf ball of claim 1 wherein a plurality of dimples having a greater diameter than the first and second dimples are arranged in the remaining areas.

3. The golf ball of claim 2, wherein the dimples have an increasing depth in the order of first dimple less than second dimples and second dimples less than other dimples.

4. The golf ball of claim 1, wherein the first dimple has a diameter of 2.0 to 3.3 mm and a depth of 0.05 to 0.15 mm, and the second dimples have a diameter of 2.8 to 3.8 mm and a depth of 0.10 to 0.18 mm.

5. The golf ball of claim 1, wherein the first dimple at the vertex is divided into substantially ⅕ sections among the five triangular areas.

6. The golf ball of claim 1, wherein on second dimple is located in each triangular area so as to surround the first dimple.

7. The golf ball of claim 1, wherein each second dimple is located so as to partially overlie one side of the triangle.

8. The golf ball of claim 1, wherein five second dimples are located adjacent to the first dimple in substantial tangential contact with the two sides of each triangle extending from the vertex.

9. The golf ball of claim 1, wherein the average depth of the dimples located within the pentagonal areas is 70 to 85% of the average depth of the dimples located in the remaining areas outside the pentagons.

10. The golf ball of claim 1, wherein the total number of dimples formed throughout the golf ball is 252 to 492.

11. A golf ball having plural types of dimples on a spherical surface, wherein the spherical surface is substantially a regular icosahedron or pseudo-icosahedron having twenty triangles, apexes of five triangles joined together at a vertex formed by each apex of the triangles.

those dimples arranged in each triangle constitute an arrangement unit, five first dimples having a smallest diameter are equidistantly arranged substantially around each vertex on the overall spherical surface, and when a pentagon which circumscribes the five first dimples is drawn with its center at the vertex, an average depth of those dimples located within twelve pentagons on the overall spherical surface is up to 95% of the average depth of those dimples located in the remaining areas outside the pentagon.

12. The golf ball of claim 11, wherein the first dimple has a diameter of 2.0 to 4.0 mm and a depth of 0.05 to 0.20 mm.

13. The golf ball of claim 11, wherein one first dimple is located in each triangular area so as to surround the first dimple.

14. The golf ball of claim 11, wherein five second dimples are located adjacent to the first dimple and in substantial tangential contact with the two sides of each triangle extending from the vertex.

15. The golf ball of claim 11, wherein the average depth of the first dimples located within the pentagonal areas is 80 to 95% of the average depth of the dimples located in the remaining areas.

16. The golf ball of claim 11, wherein the total number of dimples formed throughout the golf ball is 360 to 480.

* * * * *